US007384122B2

(12) United States Patent
Shimizu

(10) Patent No.: US 7,384,122 B2
(45) Date of Patent: Jun. 10, 2008

(54) IMAGE RECORDING APPARATUS

(75) Inventor: Masanobu Shimizu, Hachioji (JP)

(73) Assignee: Olympus Corporation, Tokyo (JP)

( * ) Notice: Subject to any disclaimer, the term of this patent is extended or adjusted under 35 U.S.C. 154(b) by 377 days.

(21) Appl. No.: 11/181,240

(22) Filed: Jul. 14, 2005

(65) Prior Publication Data

US 2006/0023021 A1 Feb. 2, 2006

(30) Foreign Application Priority Data

Jul. 30, 2004 (JP) ..... 2004-223762

(51) Int. Cl.
*B41J 2/165* (2006.01)
*B41J 2/215* (2006.01)
*B41J 2/01* (2006.01)

(52) U.S. Cl. ..... 347/34; 347/83; 347/104

(58) Field of Classification Search ..... 347/25, 347/34.93, 103, 104
See application file for complete search history.

(56) References Cited

U.S. PATENT DOCUMENTS 5,552,812 A * 9/1996 Ebinuma et al. ..... 347/34
5,717,446 A * 2/1998 Teumer et al. ..... 347/35

FOREIGN PATENT DOCUMENTS

JP 2003-220695 A 8/2003

* cited by examiner

*Primary Examiner*—Shih-Wen Hsieh
(74) *Attorney, Agent, or Firm*—Frishauf, Holtz, Goodman & Chick, P.C.

(57) ABSTRACT

An image recording apparatus includes an ink jet head which ejects ink toward a recording medium to record an image thereon, a paper feed unit which feeds the recording medium, a recording medium conveyance unit which conveys the recording medium, an intake fan provided at the recording medium conveyance unit to adsorb the recording medium by negative pressure, and an exhaust fan to remove dust from between the paper feed unit and the recording medium conveyance unit. The image recording apparatus prevents the ink jet head from not discharging ink drops and discharging ink drops curvedly because of paper dust and dust in the air, and prevents ink drops from failing to land in a proper position because of an airflow to form a new flow path in the apparatus, thereby recording a high-quality image with high reliability.

12 Claims, 7 Drawing Sheets

IMAGE RECORDING APPARATUS

CROSS-REFERENCE TO RELATED APPLICATIONS

This application is based upon and claims the benefit of priority from prior Japanese Patent Application No. 2004-223762, filed Jul. 30, 2004, the entire contents of which are incorporated herein by reference.

BACKGROUND OF THE INVENTION

1. Field of the Invention

The present invention relates to an image recording apparatus having a mechanism to remove dust from inside the apparatus.

2. Description of the Related Art

In an image recording apparatus, generally, a recording medium such as recording paper is brought into contact with a component located on a recording medium conveyance path, such as a paper feed unit for feeding the recording medium and a registration roller for stabilizing the conveyance direction of the recording medium, when the recording medium is conveyed. This contact generates a large amount of paper dust from the recording medium in the apparatus. When the recording medium is placed in the paper feed unit, the paper dust intrudes into the image recording apparatus together with dust in the air.

In an image recording apparatus using an ink jet head for a recording element, paper dust or dust is attached to a nozzle of the ink jet head for ejecting ink drops or intruded into the nozzle. If cut paper is used as a recording medium, the amount of paper dust to be generated varies with the quality of cutting of the cut paper.

For example, Jpn. Pat. Appln. KOKAI Publication No. 2003-220695 is known as prior art. This Publication discloses an apparatus wherein an airflow is generated from an ink jet head to a paper feed unit in order to prevent paper dust and dust from being attached to the ink jet head.

The Publication also discloses that air flows into a conveyance mechanism housing 101 from outside a recording head housing 102 through a wind-direction guide 104 by fans 104*a* and 104*b*, as shown in FIG. 12. This air is blown toward recording heads 114*a* to 114*d* from outside the recording head housing 102.

In a prior art image recording apparatus, an airflow is formed as illustrated in FIG. 13. More specifically, air 114 is generated close to a resist roller 109, a backup roller 110 and an ink head 100 by an adsorption fan 106 and flows under an ink jet head 100. Then, the air 114 flows toward a conveyor belt 141 through an adsorption hole 103 formed in a platen 112.

In the above Publication, the wind-direction guide 104 is provided to prevent the blown air from hitting directly on the ink jet head. However, the Publication does not take into consideration any paper dust or dust that intrudes from a flow path of the conveyance mechanism housing 101, a flow path between the wind-direction guide 104 and a recording medium, and the sides of the apparatus. In other words, the apparatus of the Publication is configured not to remove dust, such as paper dust and dust in the air, by the blown air, but to make it difficult that dust intrudes into the recording head housing 102. Since the Publication does not take into consideration the flow path of the conveyance mechanism housing 101 or the flow path between the wind-direction guide 104 and a recording medium, there is fear that dust or air will not properly be discharged to the outside of the apparatus but remain in the apparatus.

In the prior art image recording apparatus shown in FIG. 13, dust 113, such as paper dust around the ink jet head 100 and dust in the air, flow as shown in FIG. 14. In this flow, part of the dust 113 flows under the platen 112 through the adsorption hole 103, while the other dust flows toward the ink jet head 100. The dust 113 that flows toward the ink jet head 100 are likely to be attached to a nozzle 140 for ejecting ink drops. If the dust 113 is attached to the nozzle 140, there is fear that the ink drops will not be ejected or ejected cursedly to cause displacements and blur of an image and thus lower its quality remarkably. In the prior art image recording apparatus, the dust flows into the apparatus and are attached to or intruded into the ink jet head. Thus, the ink drops do not land in a proper position to degrade the quality of a recorded image remarkably. Furthermore, there is fear that dust or air will not properly be discharged to the outside of the apparatus but remain in the apparatus since the wind-direction guide is provided.

BRIEF SUMMARY OF THE INVENTION

There is provided an image recording apparatus which prevents an ink jet head from not ejecting ink drops and ejecting ink drops cursedly because of paper dust and dust in the air, and prevents dust from intruding into the apparatus from outside, thereby recording a high-quality image with high reliability.

According to an aspect of the present invention, there is provided an image recording apparatus comprising an ink jet head unit which ejects ink toward a recording medium to record an image thereon, a paper feed unit which feeds the recording medium to a platen that is provided opposite to an ejecting outlet of the ink jet head unit from which ink is ejected, a recording medium conveyance unit which conveys the recording medium, which is fed onto the platen, to a discharge outlet, an intake fan provided at the recording medium conveyance unit to adsorb the recording medium by negative pressure while the recording medium is being conveyed, and an exhaust fan to remove dust from between the paper feed unit and the recording medium conveyance unit, wherein the image recording apparatus further comprises a cover member on an outside thereof, and an inner part of the apparatus, which is covered with the cover member, is maintained at positive pressure with air from which dust is removed, in space including the ink jet head unit.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described in detail with reference to the accompanying drawings.

In the following descriptions, the conveyance direction of recording mediums is defined as an X-axis direction or a sub-scanning direction, a direction that is two-dimensionally perpendicular to the conveyance direction is defined as a Y-axis direction or a main scanning direction, and a direction that is three-dimensionally perpendicular to the X- and Y-axis directions is defined as a Z-axis direction or a vertical direction.

Figure 1:
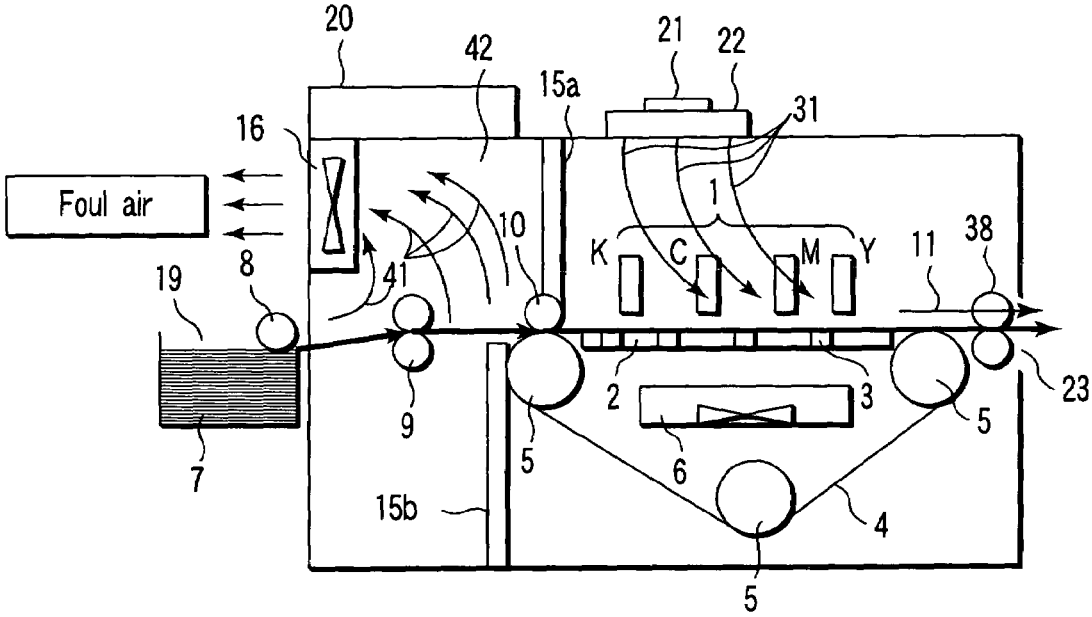
FIG. 1 is a schematic view of the internal structure of an image recording apparatus according to a first embodiment of the present invention.
Figure 2:
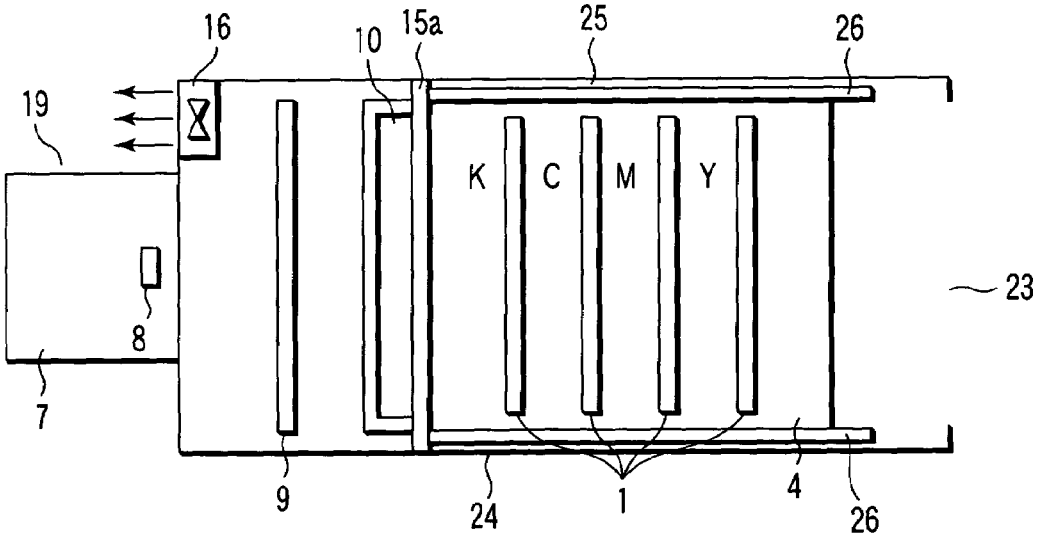
FIG. 2 is a cross-sectional view of the image recording apparatus according to the first embodiment of the present invention.
Figure 3:
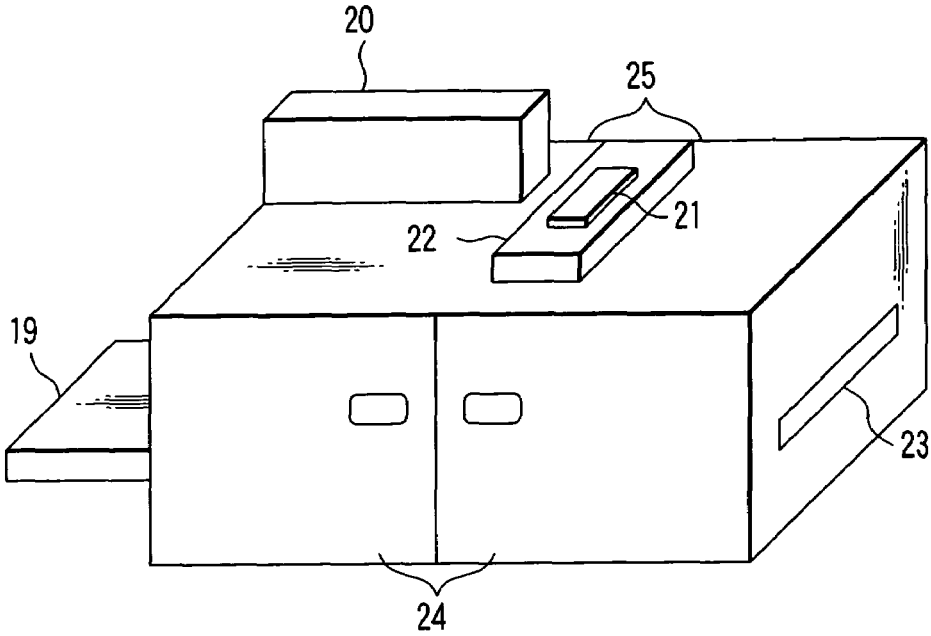
FIG. 3 is a perspective view of the image recording apparatus according to the first embodiment of the present invention.
Figure 6:
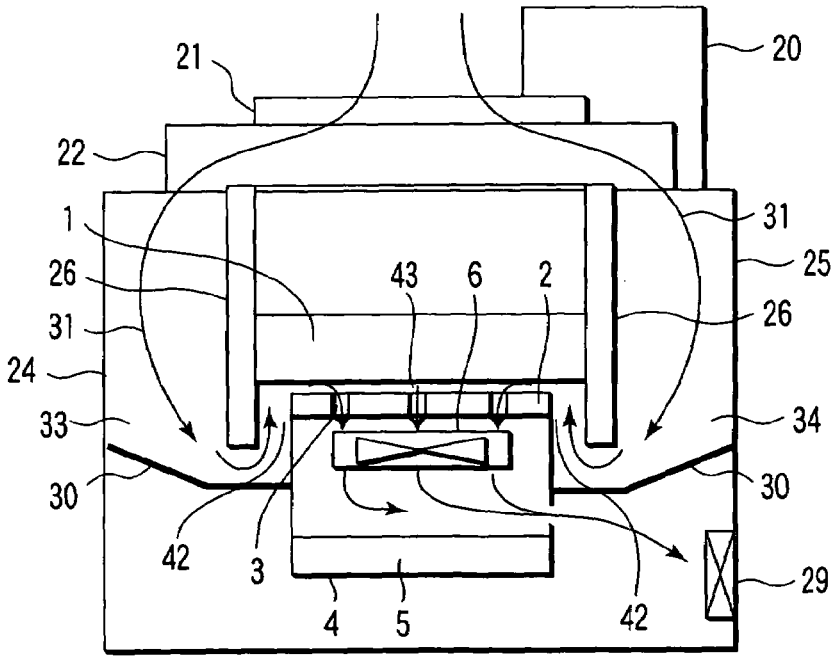
FIG. 6 is a sectional view taken from a discharge outlet of the image recording apparatus according to the first embodiment of the present invention.

An image recording apparatus according to a first embodiment of the present invention will be described with reference to FIGS. 1, 2, 3 and 6. FIG. 1 is a schematic diagram of the internal structure of the image recording apparatus. FIG. 2 is a cross-sectional view of the image recording apparatus. FIG. 3 is a perspective view of the image recording apparatus. FIG. 6 is a sectional view taken from a discharge outlet 23 of the image recording apparatus.

The image recording apparatus comprises an ink jet head 1 including a plurality of nozzles capable of ejecting ink of different colors, such as black (K), cyan (C), magenta (M) and yellow (Y) and then recording color images. These nozzles are arranged in the same direction as the conveyance direction and each have an ejecting outlet for ejecting ink in the gravitational direction (vertical direction).

In the first embodiment, the ink jet head 1 can be formed as a nozzle array having such a length as to cover the recording (maximum width) of a recording medium, or it can be formed as at least two nozzle arrays arranged in the main scanning direction and each having a plurality of short heads whose length is less than the width of a recording medium. Some of the short heads of the nozzle arrays are arranged in the conveyance direction of the recording mediums. In this case, the nozzle arrays are so fixed that they are arranged at regular pitches in the sub-scanning direction (conveyance direction). Since the nozzle arrays of the ink jet head 1 are arranged in the main scanning direction, their ejecting timings are controlled individually. With this control, the nozzle arrays of the head 1 can be formed as one line in the main scanning direction or in the width direction of each of recording mediums 7 and driven in the same manner as a conventional single line head.

The image recording apparatus comprises a belt unit that is opposed to the ink jet head 1. The belt unit includes a conveyor belt 4 that is put on three conveyor belt driving rollers 5 and an intake fan 6 provided close to the driving rollers 5. The apparatus also comprises a platen 2 that is opposed to the ink jet head 1. The platen 2 has a number of intake holes 3 for adsorbing the recording mediums 7 by taking air by the intake fan 6. This air is discharged outside the apparatus by an exhaust fan 29 provided on a rear cover 25. The conveyor belt 4 has a number of small holes (not shown) for adsorbing and holding the recording mediums 7. Accordingly, the recording mediums 7 are conveyed in the direction of arrow 11 as the conveyor belt 4 moves while adsorbing the recording mediums 7.

Around the belt unit, there are a feeder 19 for storing the recording mediums 7 to be fed, a paper feed roller 8 for picking up the recording mediums 7 from the feeder 19 one by one and then feeding them, a resist roller 9 for aligning the conveyance direction of the recording mediums 7 fed by the paper feed roller 8, a backup roller 10 having a function of aligning the recording mediums 7 in the conveyance direction and serving as a driven roller of the conveyor belt, a discharge roller 38 for discharging the recording mediums 7, and a discharge outlet 23 for discharging the recording mediums.

The apparatus comprises partition plates 15*a* and 15*b*. The partition plate 15*a* is provided in contact with the backup roller 10 on its downstream side to prevent paper dust, which is generated when the recording mediums 7 contact the paper feed roller 8, resist roller 9 and backup roller 10, and dust in the air from being sent to the ink jet head 1. The partition plate 15*b* is provided in contact with the most upstream one of the conveyor belt driving rollers 5. The contact pressure of the partition plate 15*a* is set at a very low value, such as 0.1 N or lower, to prevent the conveyability of the backup roller 10 from decreasing. With these partition plates 15*a* and 15*b*, a chamber including the paper feed roller 8, resist roller 9 and backup roller 10 and a chamber including the ink jet head 1 can completely be separated from each other. The former chamber also includes an exhaust fan 16 in its upper part. The exhaust fan 16 is used to exhaust foul air containing a great amount of paper dust out of the apparatus in the direction indicated by arrows 41. Clean air that is introduced through a fan unit 21 with a filter and a duct 22 is not blown directly to the ink jet head 1. In the first embodiment, the clean air flows toward the discharge outlet 23 and exhaust fan 29 through a flow path between the ink jet head 1 and each of a front cover 24 and a read cover 25 as shown in FIG. 6.

FIG. 3 is a perspective view of the image recording apparatus according to the first embodiment. The entire main body of the apparatus is almost hermetically sealed with covers including a front cover 24. This sealed apparatus includes a rear cover 25 that is opposed to the front cover 24 and a conveyance path. An ink bottle unit 20 for storing ink is provided on the roof of the chamber including the paper feed roller 8, resist roller 9 and backup roller 10. The fan unit 21 with a filter is provided on the roof of the chamber including the ink jet head 1, with the duct 22 interposed therebetween. The fan unit 21 allows clean air to be introduced into the chamber including the ink jet head 1 through the duct 22.

In image recording, the recording mediums 7 are picked out by the paper feed roller 8 and conveyed to the resist roller 9. The recording mediums 7 are each placed into contact with the resist roller 9 and then formed like a loop between the resist roller 9 and backup roller 10 to align their conveyance directions. The conveyance speed of the backup roller 10 is set lower than that of the resist roller 9 until the recording mediums 7 are each formed like a given loop.

Figure 4:
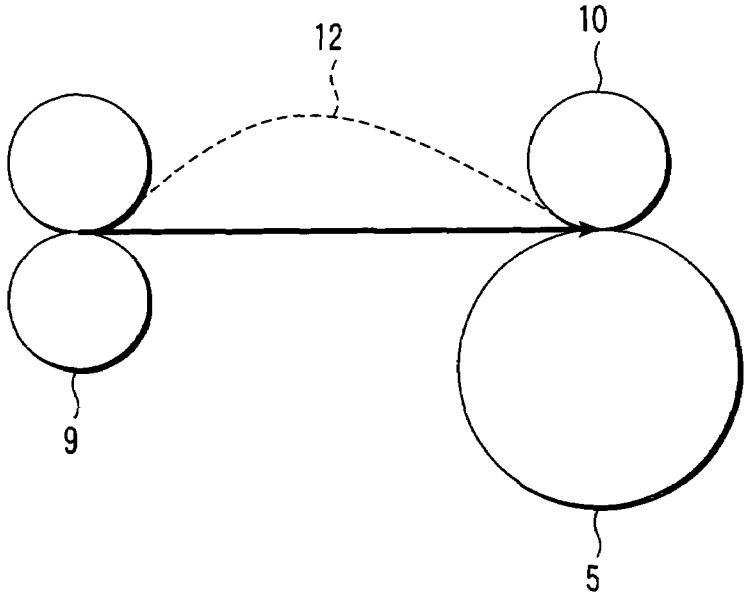
FIG. 4 is a diagram showing an example of a loop formed in the image recording apparatus according to the first embodiment of the present invention.

An example of a loop will be described in detail with reference to FIG. 4. Referring to FIG. 4, a recording medium 7 is formed like a loop between the resist roller 9 and backup roller 10 as indicated by broken line 12. After the loop is formed, when the conveyance direction of the recording medium 7 is corrected and part of the recording medium 7 is adequately adsorbed by the conveyor belt 4, a driving gear (not shown) of the resist roller 9 is released and dragged together with the recording medium 7. At this time, the recording medium 7 is suddenly flattened. In the first embodiment, a loop is formed between the resist roller 9 and backup roller 10; however, it can be done between the paper feed roller 8 and resist roller 9.

Figure 5:
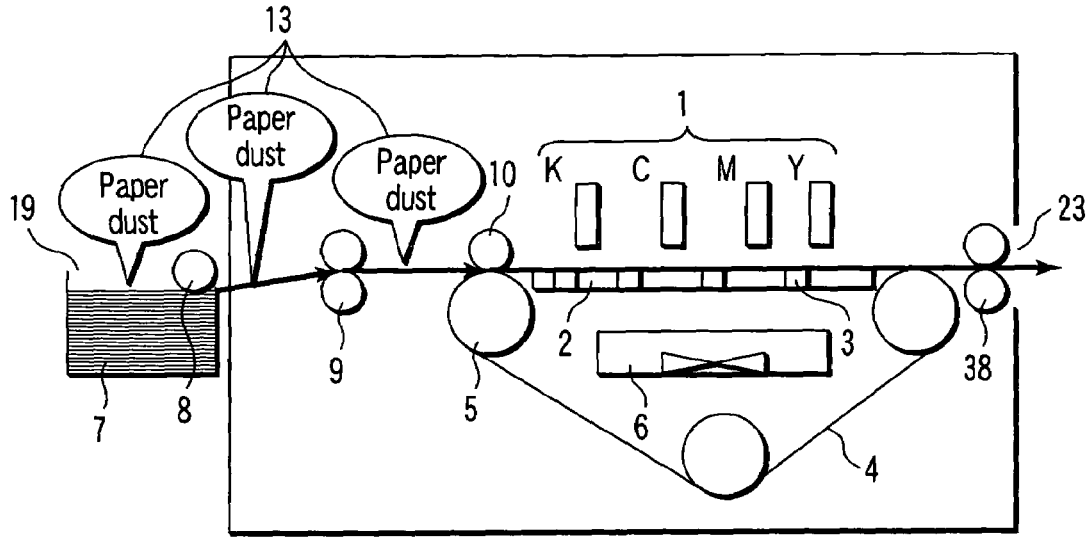
FIG. 5 is a schematic view of the image recording apparatus according to the first embodiment of the present invention, in which paper dust are generated.

A situation in which paper dust are generated from the image recording apparatus will be described in detail with reference to FIG. 5. For the sake of brevity, the partition plate 15*a*, partition plate 15*b*, exhaust fan 16, ink bottle unit 20, fan unit 21 and duct 22 shown in FIG. 1 are omitted from FIG. 5.

Paper dust 13 are generated most when a recording medium 7 is placed into contact with the paper feed roller 8, when a recording medium is flattened after it is shaped like a loop between the paper feed roller 8 and resist roller 9, and when a recording medium is suddenly changed in position from its loop to flatness. The paper dust 13 are also generated from the resist roller 9 and backup roller 10 to keep a difference in speed between each of the rollers 9 and 10 and each of the recording mediums 7. In the first embodiment, the image recording apparatus adopts a conveyor belt and thus requires the intake fan 6. Air flow is therefore caused in the image recording apparatus.

A flow of air in the image recording apparatus will be described in detail with reference to FIGS. 1, 6, 7 and 8.

First, a flow of air to discharge dust from the apparatus when a recording medium 7 is conveyed into the main body of the apparatus, will be described with reference to FIG. 1. When the recording medium 7 is formed like a loop, a large number of paper dust 13 are generated in the chamber including the paper feed roller 8, resist roller 9 and backup roller 10. Dust in the air is also conveyed from outside the apparatus while being attached to the recording medium 7. The chamber is thus filled with foul air containing dust. The foul air is exhausted out of the apparatus through the exhaust fan 16 in the direction indicated by arrows 41. Since the backup roller 10 contacts the recording medium 7, the paper dust 13 do not flow toward the ink jet head 1 through the contact portion with less frequently.

Most of the paper dust 13 attached to the surface of the recording medium 7 and most of the dust attached to the recording medium 7 when it is left in the feeder 19 are detached therefrom when it is suddenly changed from its loop to flatness and when it is placed into contact with the paper conveyance path. These paper dust 13 and dust are floated and discharged from the main body of the apparatus through the exhaust fan 16. Even though paper dust 13 and dust are attached to the surface of the recording medium 7, they are compressed by the backup roller 10 and fixed to the recording medium 7 or fixed to the backup roller 10. Thus, the paper dust 13 float and flow toward the ink jet head 1 with less frequency.

In the configuration of the apparatus, the partition plate 15*a* is provided on the downstream side of the backup roller 10 where the recording medium 7 that generates paper dust 13 is formed like a loop and then flattened suddenly when it comes closest to the ink jet head 1, and the partition plate 15*b* is provided on the upstream side one of the conveyor belt driving rollers 5.

As described above, the partition plates 15*a* and 15*b* are provided close to the backup roller 10 and the conveyor belt driving roller 5, and the backup roller 10 serves as one for dividing an airflow. The space for the paper feed unit and the space for the ink jet head 1 can thus be separated easily without decreasing paper conveyability. Accordingly, it is possible to reduce paper dust 13 that flow from the paper feed unit to the ink jet head 1.

Clean air 31 that flows from the fan unit 21 through the duct 22 will be described in detail with reference to FIGS. 1 and 6.

The chamber including the ink jet head 1 ranges from the partition plates 15*a* and 15*b* to the discharge outlet 23. The clean air 31 introduced through the fan unit 21 flows toward the conveyor belt through a gap formed under a guide plate 26 along two flow paths formed between the front cover 24 and the guide plate 26 and between the rear cover 25 and the guide plate 26. Most of the clean air 31 does not flow under the conveyor belt 4 but toward the discharge outlet 23 since a guide plate 30 is provided. Part of the clean air that flows under the conveyor belt 4 is exhausted from the apparatus through the exhaust fan 29 provided under the guide plate 30 that is close to the rear panel 25. The ink jet head 1 is interposed between two guide plates 26 and its top is not open. No flow paths are therefore formed, or no clean air 31 flows into the ink jet head 1 directly.

Referring to FIG. 6, a gap 42 in the Y-axis direction between the guide plate 26 and the conveyor belt 4 is considerably larger than a gap 43 in the Z-axis direction between the ink jet 1 and the conveyor belt 4. In the first embodiment, the gap 42 is set at 10 mm and the gap 43 is set at about 2 mm. It is favorable that (the area of) the gap 42 be, for example, five or more times as large as (the area of) the gap 43.

Figure 7:
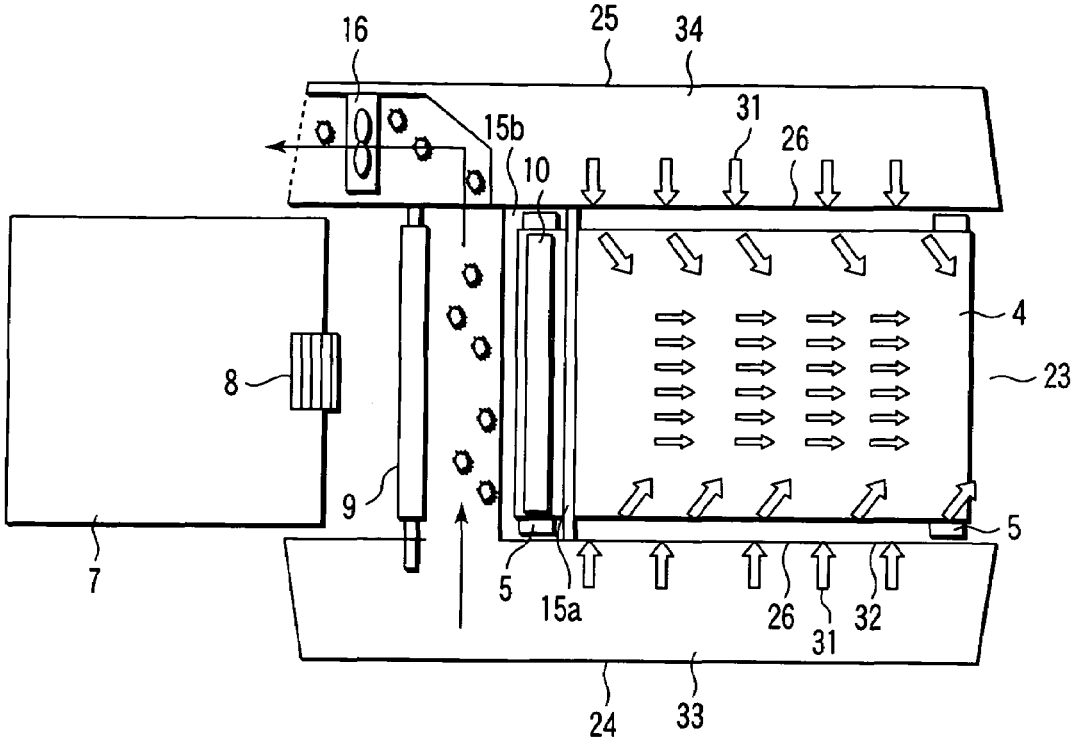
FIG. 7 is a cross-sectional view of the image recording apparatus according to the first embodiment of the present invention, in which no recording medium is placed on a conveyor belt.

FIG. 7 is a cross-sectional view of the main body of the image recording apparatus. In FIG. 7, no recording mediums 7 are adsorbed or conveyed onto the conveyor belt 4. The ink jet head 1 is not shown in FIG. 7.

The apparatus is divided into two chambers by the partition plates 15*a* and 15*b*: one chamber is a paper feed unit including the paper feed roller 8, resist roller 9 and backup roller 10; and the other chamber is an image recording unit including the ink jet head 1, conveyor belt 4 and discharge outlet 23. In the paper feed unit, a paper guide (not shown) and a recording medium 7 is placed into contact with each other to cause dust such as a large number of paper dust 13 and dust in the air. In order to prevent the dust from intruding into the image recording unit, the dust is adsorbed and discharged from between the resist roller 9 and backup roller 10 through the exhaust fan 16.

The clean air 31 that is introduced from the fan unit 21, which is provided on the top of the apparatus as shown in FIG. 1, through the duct 22, flows into space 33 between the front cover 24 and guide plate 26 and space 34 between the rear cover 25 and guide plate 26. The space 33 is maintained at positive pressure against outside air, as is the space 34. As shown in FIG. 6, the clean air 31 that flows into the space 33 and space 34 is introduced toward the conveyor belt 4 through the gap 42 between the guide plate 26 and conveyor belt 4 in the Y-axis direction. When no recording medium 7 is conveyed by the conveyor belt 4, the clean air 31 is introduced toward the conveyor belt 4 from the space 33 and space 34 by the intake fan 6 and exhausted out of the main body of the image recording apparatus by the exhaust fan 29 through the intake holes 3 of the platen 2. The apparatus is maintained at positive pressure and has a function of preventing dust intruding into the apparatus from the air through the front cover 24 and rear cover 25.

Figure 8:
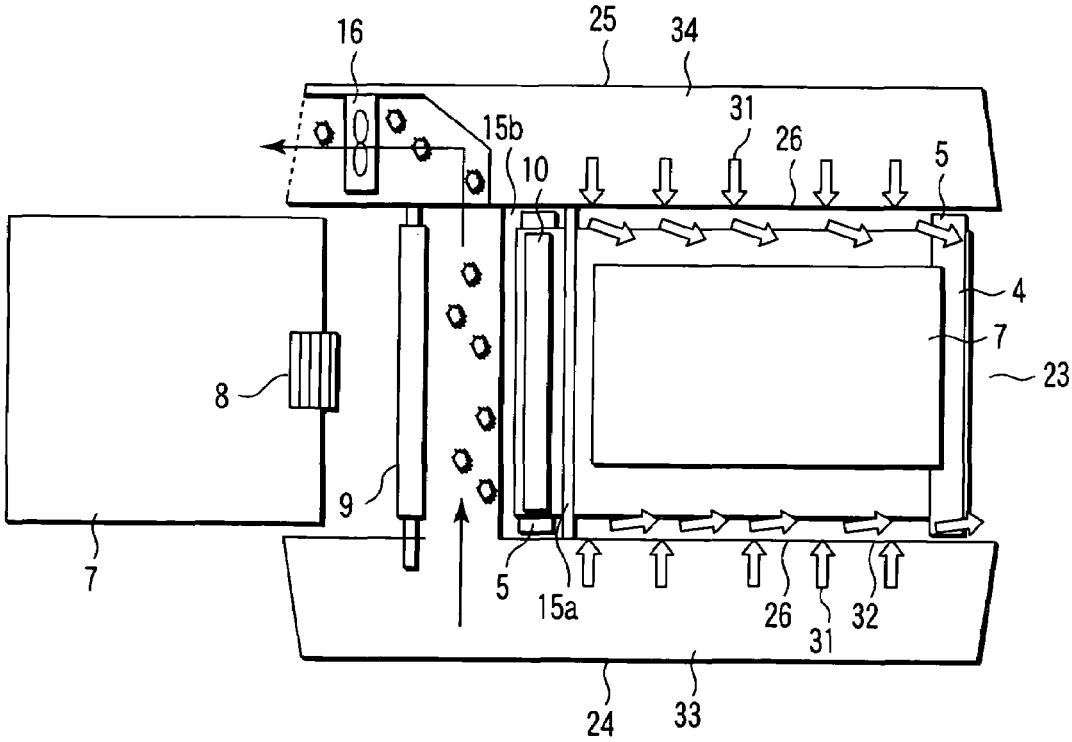
FIG. 8 is a cross-sectional view of the image recording apparatus according to the first embodiment of the present invention, in which a recording medium is placed on the conveyor belt.

FIG. 8 is another cross-sectional view of the main body of the image recording apparatus in which a recording medium 7 is being conveyed on the conveyor belt 4. The small holes of the conveyor belt 4 and the intake holes 3 of the platen are almost blocked with the recording medium 7. The amount of clean air 31 taken from the fan unit 21 by the intake fan 6 is reduced. In order to maintain the positive pressure of the chamber including the ink jet head 1, the amount of clean air 31 that flows toward the ink jet head 1 from the space 33 and space 34 is reduced. Thus, the amount of displacement in ink drops ejected from the ink nozzle, which is caused by an airflow, is decreased, as is the amount of displacement in color when an image is recorded. Most of the clean air 31 passes through space surrounded by the guide plates 26 and the conveyor belt 4 and then flows in the direction of the discharge outlet 23.

As described above, when no recording medium 7 is conveyed onto the conveyor belt 4, the clean air 31 flows toward the conveyor belt 4 by the intake fan 6 thereof. No dust is attached to the ink jet head 1. When a recording medium 7 is conveyed, the intake holes 3 of the platen 2 and conveyor belt 4 are blocked with the recording medium 7 and thus the amount of air flowing toward the conveyor belt 4 is reduced. Consequently, the amount of displacement in ink drops due to the flow of air is small, and a high-quality image can be formed.

The chamber including the ink jet head 1 is maintained at the positive pressure in the inner part of the apparatus that is covered with the front cover 24 and rear cover 25. It is thus possible to prevent dust from intruding into the apparatus from the air and prevent dust from being attached to the nozzle of the ink jet head 1. Since air flows toward the discharge outlet 23 that is the only large opening, the dust that intrudes into the apparatus can be minimized.

Figure 9:
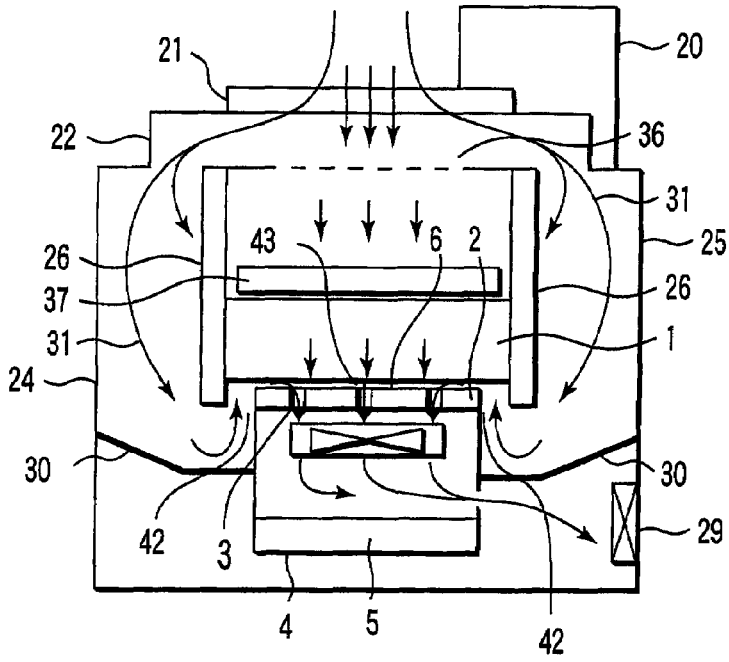
FIG. 9 is a schematic view of an image recording apparatus according to a second embodiment of the present invention, which has an opening above a head unit.

An image recording apparatus according to a second embodiment of the present invention will be described with reference to FIG. 9.

The same constituting elements as those of the first embodiment are indicated by the same reference numerals and their detailed descriptions are omitted. In the second embodiment, an opening 36 is formed in the top of an ink jet head 1 that is interposed between two guide plates 26, as shown in FIG. 9.

The apparatus of the second embodiment has a function of preventing dust from intruding into the ink jet head 1 by clean air 31 that is blown from a fan unit 21 with a filter through a duct 22. The apparatus also has a function of cooling heat generated from a head driving substrate 37, which is arranged between the opening 36 and the ink jet head 1, by blowing clean air 31 directly into the substrate 37. The clean air 31 that has cooled the head driving substrate 37 flows toward a conveyor belt 4. The substrate 37 can thus be cooled without using any dedicated cooling fan.

A slight amount of air that flows toward the conveyor belt 4 from a gap between the ink jet head 1 and a head supporting member (not shown) is part of clean air 31 including no dust. Thus, there is no danger that dust will be attached to the ink jet head 1.

An image recording apparatus according to a third embodiment of the present invention will be described with reference to FIG. 10.

The same constituting elements as those of the first embodiment are indicated by the same reference numerals and their detailed descriptions are omitted.

Figure 10:
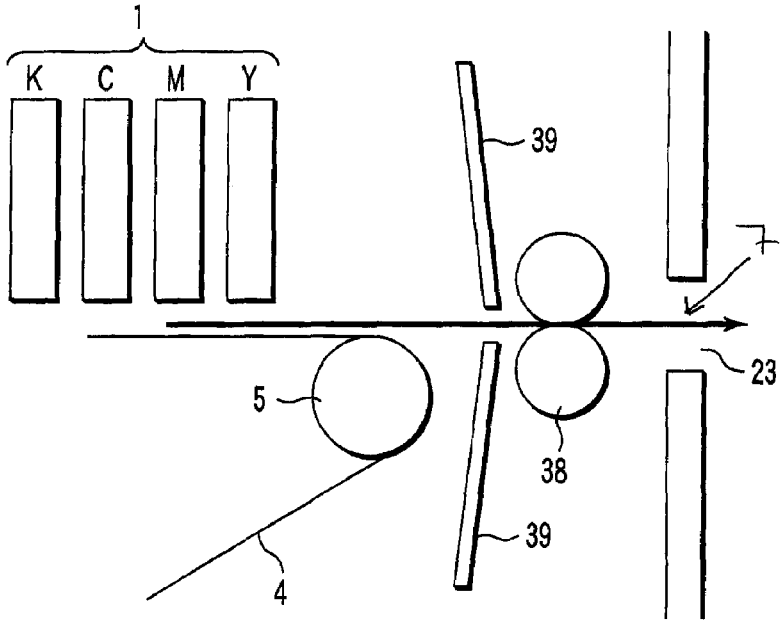
FIG. 10 is a schematic view of an image recording apparatus according to a third embodiment of the present invention, which has a partition plate near a discharge outlet.

FIG. 10 shows an enlarged view of a discharge outlet 23 and its periphery. An ink jet head 1, a conveyor belt 4, a conveyor belt driving roller 5, a recording medium 7, a discharge roller 38 and a partition plate 39 with a slit are arranged close to the discharge outlet 23. They are included in the image recording apparatus as shown in FIG. 1.

In the first embodiment, the clean air 31 flows toward the discharge outlet 23 through the space 33 between the front cover 24 and guide plate 26 and the space 34 between the rear cover 25 and guide plate 26. A large amount of clean air 31 flows toward the end portions of the front and rear covers 24 and 25, whereas a small amount of clean air 31 flows to the central part near the discharge outlet 23. When air flows to the surrounding of the apparatus, a backflow of air may occur through the discharge outlet. In the third embodiment, therefore, the partition plate 39 with a slit is provided between the ink jet head 1 and the discharge roller 38 in the longitudinal direction of the discharge outlet 23.

Consequently, in the third embodiment, dust can be prevented from intruding into the apparatus from the air through the discharge outlet 23. The smaller the width of the slit of the partition plate 39, the more the air can be prevented from intruding. In the third embodiment, the width of the slit is set at 3 mm in order to secure the conveyability of recording mediums. This conveyability is improved by inclining the partition plate 39 toward the paper feed side with reference to the slit.

As described above, the partition plate is provided close to the discharge outlet to minimize dust that intrude into the apparatus from the air and prevent the dust from being attached to the ink jet head.

In the third embodiment, the ink jet head 1 is a fixed head capable of covering the maximum width of each of the recording mediums 7. The ink jet head 1 can be moved in the main scanning direction that is the width direction of the recording mediums 7.

An image recording apparatus according to a fourth embodiment of the present invention will be described with reference to FIG. 11.

The same constituting elements as those of the first embodiment are indicated by the same reference numerals and their detailed descriptions are omitted.

Figure 11:
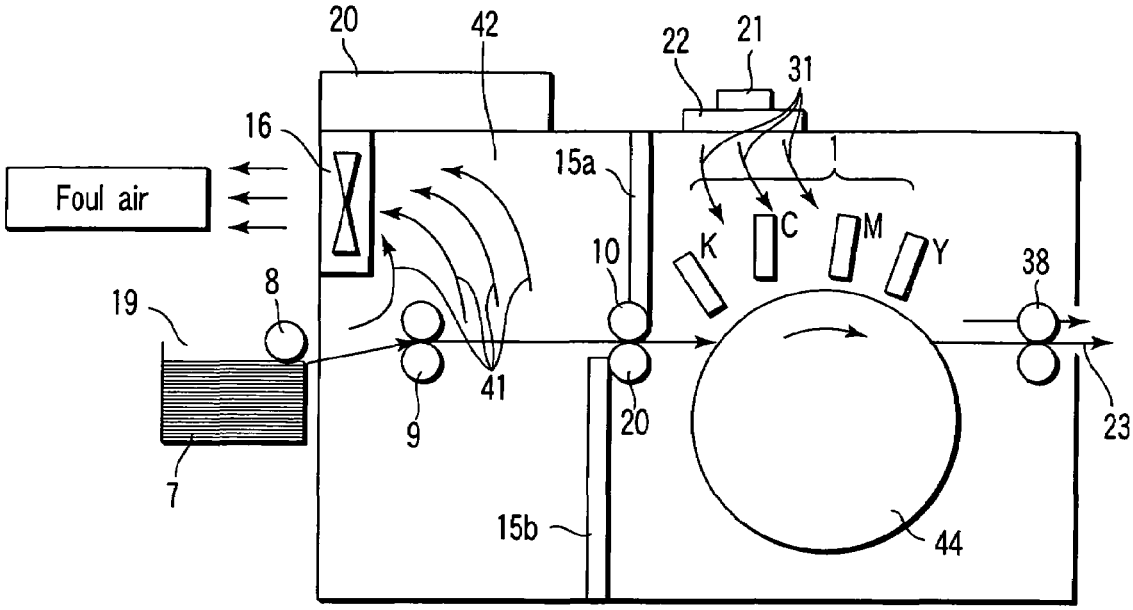
FIG. 11 is a schematic view of an image recording apparatus according to a fourth embodiment of the present invention, which has a rotating cylindrical platen.
Figure 12:
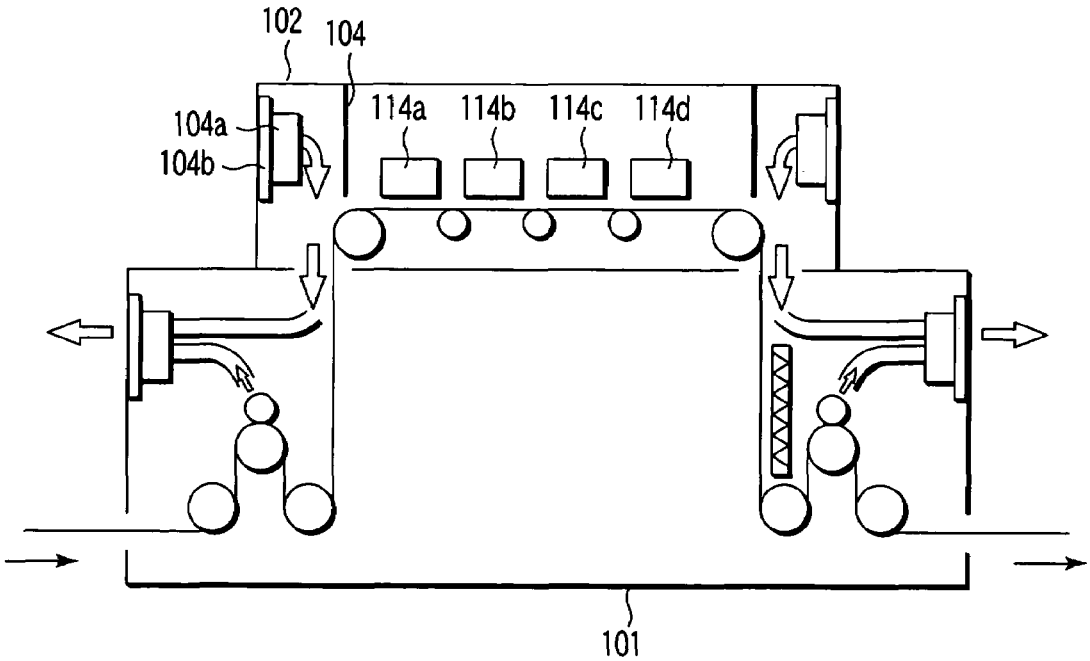
FIG. 12 PRIOR ART
FIG. 12 is a schematic view of a prior art image recording apparatus for generating air.
Figure 13:
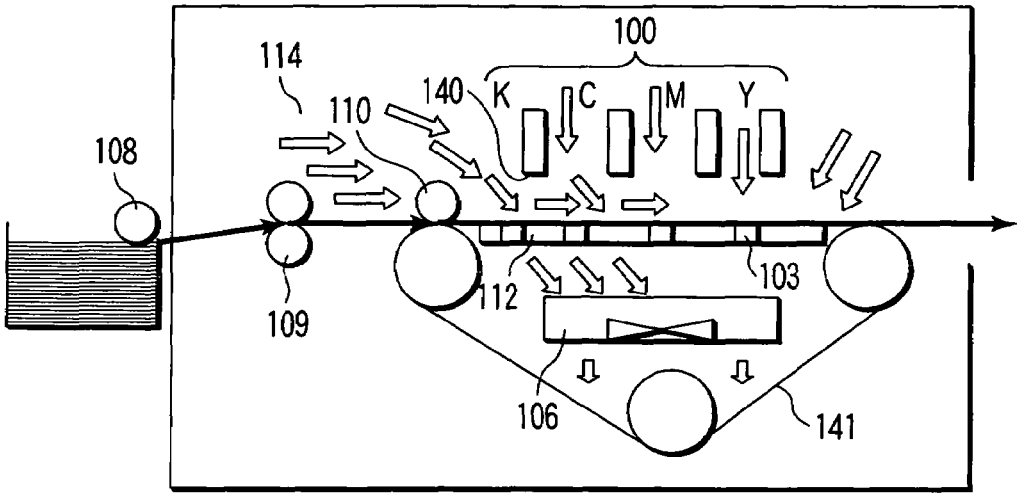
FIG. 13 PRIOR ART
FIG. 13 is a schematic view of a prior art image recording apparatus in which air flows.
Figure 14:
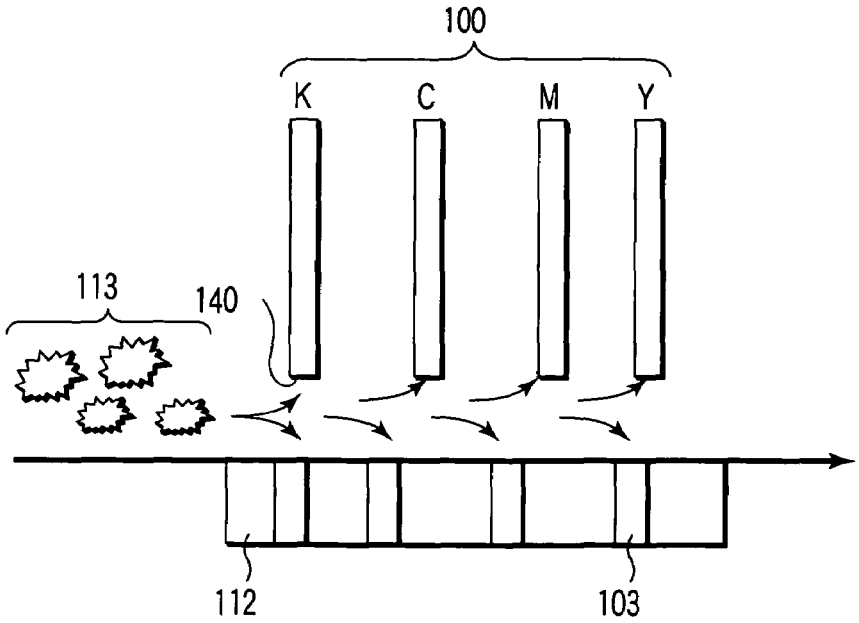
FIG. 14 PRIOR ART
FIG. 14 is a diagram showing a flow of dust near an ink jet head arranged in the prior art image recording apparatus.

FIG. 11 shows a configuration of an image recording apparatus using a cylindrical platen 44 that rotates. Like a belt platen, the cylindrical platen 44 allows recording mediums 7 to be conveyed horizontally. The cylindrical platen 44 has a recording medium adsorbing function not shown and the mechanism has a hole for adsorbing the recording mediums.

The recording mediums 7 are fed from a feeder 19 by a paper feed roller 8 and then conveyed to the cylindrical platen 44 through a resist roller 9 and a backup roller 10. The recording mediums 7 are adsorbed by the cylindrical platen 44 and discharged from a discharge outlet 23 through a gap between the ink jet head 1 and the platen 44 by a discharge roller 38.

In the fourth embodiment, a paper feed unit can be separated from space around the ink jet head 1 by partition plates 15*a* and 15*b*, and dust that intrudes into the apparatus by clean air from a fan unit 21 with a filter can be minimized.

According to the present invention, there can be provided an image recording apparatus which prevents an ink jet head from not discharging ink drops and discharging ink drops cursedly because of paper dust and dust in the air, and prevents dust from intruding into the apparatus from outside, thereby forming a high-quality image with high reliability.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image recording apparatus comprising:

an ink jet head unit which ejects ink toward a recording medium to record an image thereon;

a paper feed unit which feeds the recording medium to a platen that is provided opposite to an ejecting outlet of the ink jet head unit from which the ink is ejected;

a recording medium conveyance unit which conveys the recording medium, which has been fed onto the platen, to a discharge outlet;

an intake fan provided at the recording medium conveyance unit to adsorb the recording medium by negative pressure while the recording medium is being conveyed by the recording medium conveyance unit;

an exhaust fan to remove dust from between the paper feed unit and the recording medium conveyance unit; and a cover member on an outside of the image recording apparatus;

wherein a space including the ink jet head unit in an inner part of the apparatus, which is covered with the cover member, is maintained at positive pressure with air from which dust is removed.

2. The image recording apparatus according to claim 1, wherein the air flows in a direction toward the discharge outlet.

3. The image recording apparatus according to claim 1, further comprising an electrical substrate, wherein the air is used at least one of to cool the electrical substrate and to cool the ink jet head unit for heat radiation.

4. The image recording apparatus according to claim 1, wherein the air is taken from outside the apparatus through a dust removing filter.

5. The image recording apparatus according to claim 1, wherein the air is taken from outside the apparatus through a dust removing filter and passes between the ink jet head unit and the cover member, and wherein one part of the air is passes through the ink jet head unit and the platen and is exhausted from under the platen to outside of the apparatus, and another part of the air passes between the ink jet head unit and the cover member and is exhausted from the discharge outlet to outside of the apparatus.

6. The image recording apparatus according to claim 5, wherein the apparatus further comprises a guide plate provided between the cover member and the ink jet head unit to guide air for removing the dust, and wherein said another part of the air passes through a gap between the platen and the guide plate and is exhausted from the discharge outlet to outside of the apparatus.

7. The image recording apparatus according to claim 1, wherein the ink jet head unit comprises a line head.

8. The image recording apparatus according to claim 1, wherein the recording medium conveyance unit comprises a belt adsorption recording medium conveyance unit.

9. The image recording apparatus according to claim 1, wherein the recording medium conveyance unit comprises a cylinder adsorption recording medium conveyance unit.

10. An image recording apparatus comprising:

an ink jet head unit which ejects ink toward a recording medium to record an image thereon;

a paper feed unit which feeds the recording medium to a platen that is provided opposite to an ejecting outlet of the ink jet head unit from which the ink is ejected;

a recording medium conveyance unit which conveys the recording medium, which has been fed onto the platen, to a discharge outlet;

an intake fan provided at the recording medium conveyance unit to adsorb the recording medium by negative pressure while the recording medium is being conveyed by the recording medium conveyance unit;

an exhaust fan to remove dust from between the paper feed unit and the recording medium conveyance unit; and a cover member on an outside of the image recording apparatus;

wherein a space including the ink jet head unit in an inner part of the apparatus, which is covered with the cover member, is maintained at positive pressure with air from which dust is removed; and wherein the apparatus further comprises a guide plate provided between the cover member and the ink jet head unit to guide air for removing the dust, and wherein a gap between the ink jet head unit and the platen is narrower than a gap between the platen and the guide plate.

11. An image recording apparatus comprising:

an ink jet head unit which ejects ink toward a recording medium to record an image thereon;

a paper feed unit which feeds the recording medium to a platen that is provided opposite to an ejecting outlet of the ink jet head unit from which the ink is ejected;

a recording medium conveyance unit which conveys the recording medium, which has been fed onto the platen, to a discharge outlet;

an intake fan provided at the recording medium conveyance unit to adsorb the recording medium by negative pressure while the recording medium is being conveyed by the recording medium conveyance unit;

an exhaust fan to remove dust from between the paper feed unit and the recording medium conveyance unit; and a cover member on an outside of the image recording apparatus;

wherein a space including the ink jet head unit in an inner part of the apparatus, which is covered with the cover member, is maintained at positive pressure with air from which dust is removed; and wherein the apparatus further comprises a partition plate provided between the discharge outlet and the ink jet head unit.

12. An image recording apparatus comprising:

an ink jet head unit which ejects ink toward a recording medium to record an image thereon;

a paper feed unit which feeds the recording medium to a platen that is provided opposite to an ejecting outlet of the ink jet head unit from which the ink is ejected;

a recording medium conveyance unit which conveys the recording medium, which has been fed onto the platen, to a discharge outlet;

an intake fan provided at the recording medium conveyance unit to adsorb the recording medium by negative pressure while the recording medium is being conveyed by the recording medium conveyance unit;

an exhaust fan to remove dust from between the paper feed unit and the recording medium conveyance unit; and a cover member on an outside of the image recording apparatus;

wherein a space including the ink jet head unit in an inner part of the apparatus, which is covered with the cover member, is maintained at positive pressure with air from which dust is removed; and wherein the apparatus further comprises a partition plate provided between the paper feed unit and the ink jet head unit.

* * * * *